United States Patent [19]

Walker

[11] 4,212,130

[45] Jul. 15, 1980

[54] PLAYHOUSE WITH ELEMENTS BASED ON TWO MODULAR UNITS

[76] Inventor: June F. Walker, 3010 Anacapa Pl., Fullerton, Calif. 92635

[21] Appl. No.: 894,499

[22] Filed: Apr. 7, 1978

[51] Int. Cl.[2] ..... A63H 33/10

[52] U.S. Cl. ..... 46/12; 35/34; 46/11; 46/21; 46/31; 52/DIG. 10

[58] Field of Search ..... 46/23, 26, 19, 21, 12, 46/30, 31; 35/34, 72; 52/DIG. 10

[56] References Cited

U.S. PATENT DOCUMENTS

| | | | |
|---|---|---|---|
| 659,199 | 10/1900 | Anderton | 40/21 A |
| 2,454,307 | 11/1948 | Cooley | 46/30 X |
| 2,754,550 | 7/1956 | Johnson et al. | 46/12 X |
| 3,120,078 | 2/1964 | Bessinger | 46/31 |
| 3,231,942 | 2/1966 | O'Brien | 46/12 X |

FOREIGN PATENT DOCUMENTS

| | | | |
|---|---|---|---|
| 571159 | 1/1924 | France | 46/31 |
| 835421 | 9/1938 | France | 46/21 |
| 140329 | 3/1920 | United Kingdom | 46/21 |

*Primary Examiner*—F. Barry Shay

[57] ABSTRACT

A modular playhouse comprising a plurality of sections derived from two related modular units. The first modular unit is a right angle triangle having its hypotenuse equal to twice its base. A set of two-dimensional sections based on the triangular module having linear dimensions each of which corresponds either to the base, the hypotenuse or the height of said triangle. The second module is a rectangle having a width equal to the triangle base and a length equal to the triangle hypotenuse. A set of two-dimensional sections based on the rectangular module have linear dimensions corresponding to the length and width of the rectangular module. The box in which the sections are packaged is adapted to form a table-like structure for supporting and securing said sections, the size and proportions of said table-like structure also being derived from the two related modular units. Said sections are connected to each other and to the table-like structure by bendable or flexible strips.

11 Claims, 8 Drawing Figures

FIG. 4
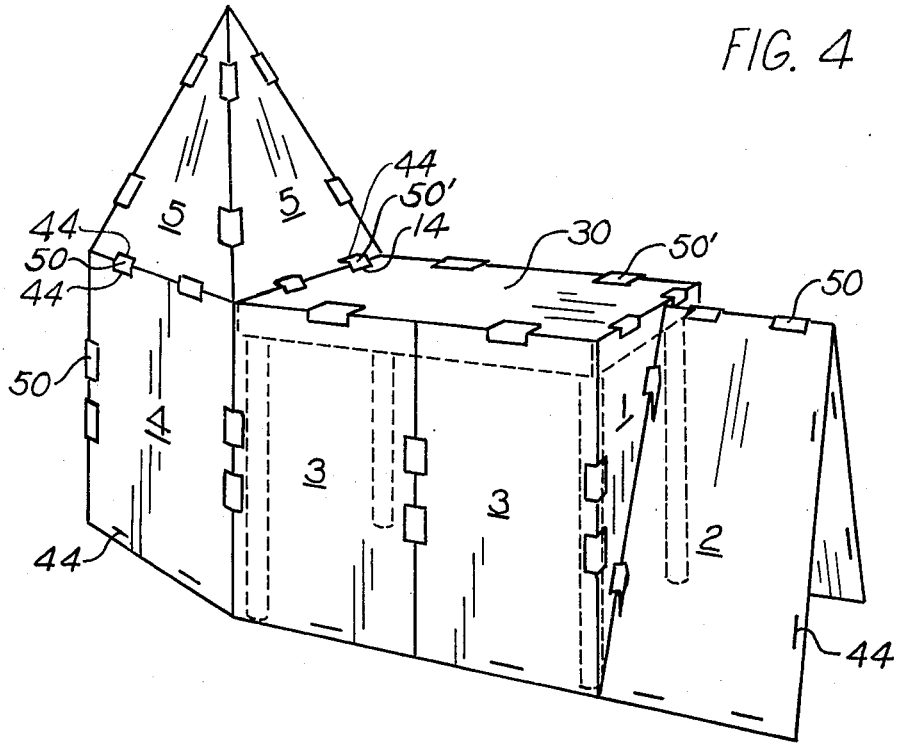
FIG. 5
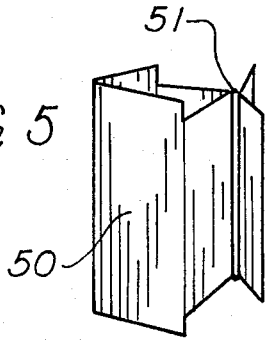
FIG. 7
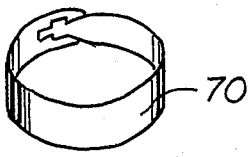
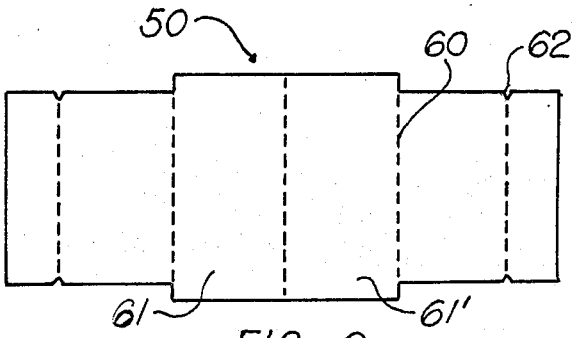
FIG. 6
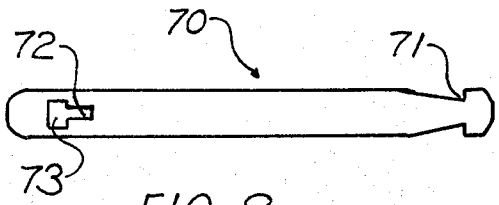
FIG. 8

PLAYHOUSE WITH ELEMENTS BASED ON TWO MODULAR UNITS

FIELD OF THE INVENTION

The invention relates generally to modular structures and more particularly concerns the provision of a modular playhouse for small children to build by themselves, said modular playhouse preferably provided in kit form comprising supporting means and a plurality of sections so that a large variety of spatial arrangements can be made.

BACKGROUND OF THE INVENTION

Many different playhouses have been designed for children's enjoyment. Usually the pieces of these playhouses fit together in a predetermined configuration allowing little variation in the buildings constructed. Furthermore, most playhouses require an adult's assistance for assembly.

SUMMARY OF THE INVENTION

My invention is a modular playhouse which a small child can assemble by himself in a selected spatial formation and which he can reassemble in many different ways.

The modular system for the playhouse in uniquely based on two related modular units. The first modular unit is a right triangle so proportioned that its hypotenuse is twice as long as its base. The second modular unit is a rectangle; its length and width correspond to the hypotenuse and base of the first modular unit.

The modular playhouse comprises a plurality of sections derived from these two related modular units.

The box in which the sections are packaged is adapted to form a table-like structure for supporting the playhouse. This provides stability and aids the child during the construction of the playhouse. The dimensions of the table-like structure are also derived from the two modular units.

Means for connecting the sections of the playhouse ones to the others and to the table-like structure comprise a plurality of bendable or flexible strips.

This modular system allows a surprising number of variations for the modular playhouse.

In view of the foregoing, the principal object of the invention is to provide a playhouse for children which can be rearranged to form many different configurations, thus stimulating the creative abilities of children.

Another object of the invention is to provide a playhouse which small children can easily construct by themselves.

A further object of the invention is to provide a means for supporting and stabilizing the playhouse.

Another object of the invention is to provide a simple means for connecting and disconnecting the sections of the playhouse.

BRIEF DESCRIPTION OF THE DRAWINGS

FIG. 4 is a perspective view showing one version of the modular playhouse constructed around the table-like structure illustrated in FIG. 3 and using panels illustrated in FIG. 1.

FIG. 5 is a perspective view showing an example of one means for connecting the sections of the playhouse ones to the others and to the table-like structure. Said connecting means comprises a plurality of bendable strips and a plurality of continuous elastic bands.

FIG. 6 is a plan view of the connecting means illustrated in FIG. 5.

FIG. 7 is a perspective view showing an alternate means for connecting the panels of the playhouse, said means comprising a plurality of flexible strips.

FIG. 8 is a plan view of the connecting means illustrated in FIG. 7.

DETAILED DESCRIPTION

Figure 1:
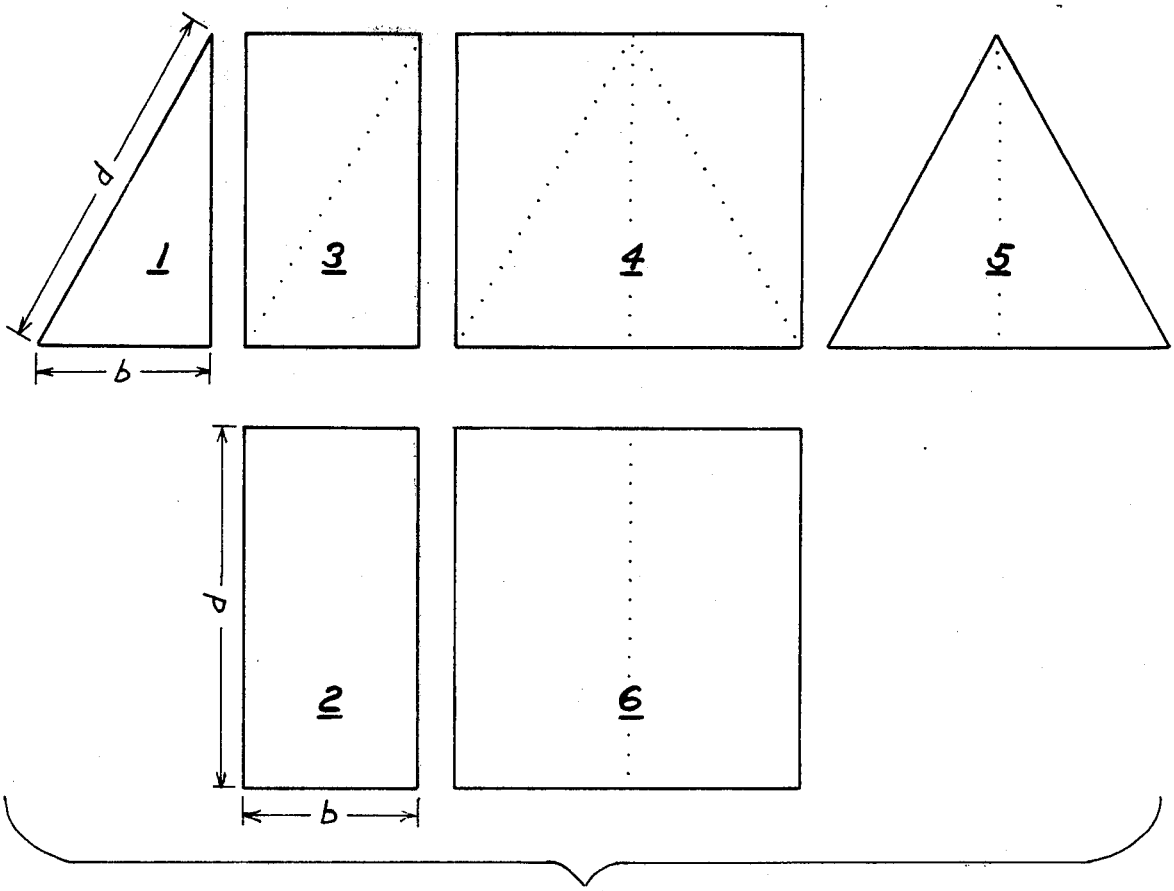
FIG. 1 is a plan view showing the shapes and size relations of the playhouse sections. Panels 1 and 2 represent the two related modular units which regulate said section shapes and sizes. Said sections comprise a plurality of triangular panels regulated by the first modular unit, a plurality of rectangular panels regulated by the first modular unit, and a plurality of rectangular panels regulated by the second modular unit.

Referring now to the drawings in detail, wherein like numerals indicate like elements, FIG. 1 shows the shapes and size relations of the panels from which the modular playhouse is built. Panel 1 and panel 2 represent the two related modular units of the modular system used for the playhouse.

Panel 1 is a right triangle so proportioned that its hypotenuse is twice as long as its base. The measurements of its hypotenuse and base are designated by the letters d and b, respectively.

Panel 2 is a rectangle. Its length and width correspond in measurement to the hypotenuse and base of panel 1, respectively.

Panels 3, 4, and 5 are aggregates of the first modular unit (panel 1). Panel 3 is a rectangle which can be subdivided into two panels 1 as shown by the dotted line. Panel 4 is a rectangle which can be subdivided into four panels 1. Panel 5 is an equilateral triangle which can be subdivided into two panels 1.

Panel 6 is an aggregate of the second modular unit (panel 2). Panel 6 is a rectangular panel having four equal sides (a square) which can be subdivided into two panels 2.

With just these six panels an unusually large number of configurations for the playhouse can be made.

It should be noted that each of the exterior dimensions of the six panels corresponds to either the hypotenuse, the base, or the height of panel 1.

Figure 2:
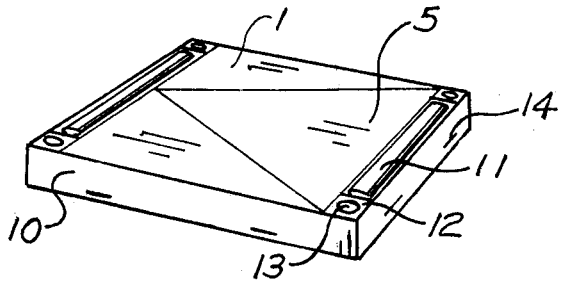
FIG. 2 is a perspective view showing the lower portion of the box in which the panels of the modular playhouse are packaged together with four elongate members.

FIG. 2 shows the lower portion of a box 10 adapted for packaging the modular playhouse. The bottom part of the box 10 is a square corresponding to panel 6; its exterior dimensions are equal in measurement to the length of the second modular unit.

The panels illustrated in FIG. 1 can be compactly stacked inside box 10. Typical panels 1 and 5 are shown on top of the stack of panels in box 10. In the spaces left on either side of the stacked panels, four elongate members 11 are placed, two deep on each side. The height of elongate members 11 is equal to the height of the first modular unit (panel 1).

Joint elements 12 are provided with openings 13 therein and are affixed to the interior corners of box 10 for attaching elongate members 11.

The lower portion of box 10 (in both FIGS. 2 and 3) is provided with a plurality of apertures 14 therethrough near the edges of the bottom part of box 10.

Figure 3:
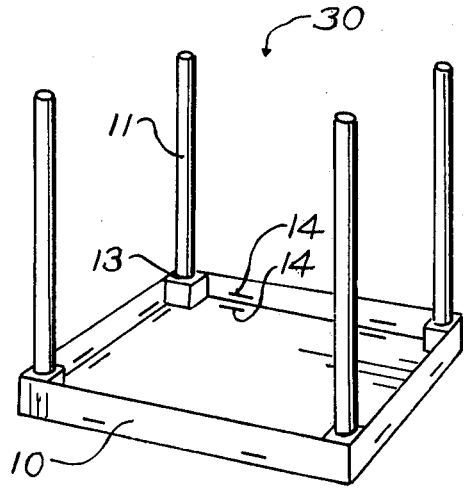
FIG. 3 is a perspective view showing supporting means for the playhouse comprising the lower portion of the box illustrated in FIG. 2 with the four elongate members attached to form a table-like structure.

FIG. 3 shows the lower portion of box 10 with its contents removed. The elongate members 11 are adapted to be removably inserted into openings 13 to form a table-like structure designated generally by reference numeral 30.

Since its dimensions are derived from the two related modular units, table-like structure 30 can serve as a framework for supporting and stabilizing the modular playhouse.

FIG. 4 shows a selected spatial arrangement for the modular playhouse using panels illustrated in FIG. 1. The playhouse is constructed around the table-like structure 30 the hidden part of which is indicated with dash lines.

In constructing this version of the playhouse, two panels 3 are connected to the front side of table-like structure 30. A three-sided cupola formed from three panels 5 is also connected to table-like structure 30 and is placed on top of two panels 4. On the opposite side, two panels 2 are connected to two panels 1 to form a pointed tunnel. The back side (not shown) of the playhouse might consist of one panel 4.

The panels are provided with a plurality of apertures 44 therethrough near the peripheral edges thereof for use in connecting the panels.

Bendable strips 50 are shown removably linking pairs of apertures 44, passing through and extending between members of said aperture 44 pairs opposing one another on adjacent panels.

Bendable strips 50' are shown removably linking pairs of panel apertures 44 and box 10 apertures 14.

FIG. 5 shows an enlarged and complete view of bendable strip 50 (partially shown in FIG. 4). Continuous elastic band 51 is adapted to be removably attached under tension around opposing end portions of strip 50 to hold those portions contiguous one to another.

FIG. 6 shows a plan view of bendable strip 50 (illustrated in FIG. 5). Transverse scorings 60 mark off strip 50 into segments. When strip 50 is bent on scorings 60, its opposing end portions are contiguous.

Segments 61 and 61' in the central portion of strip 50 are at least as wide as the distance of apertures 44 from the peripheral edges of the panels. Notches 62 retain elastic band 51.

FIG. 7 shows an enlarged view of an alternate connecting means. Flexible strip 70 is adapted to removably link pairs of apertures 44, passing through and extending between members of said aperture 44 pairs opposing one another on adjacent panels.

FIG. 8 is a plan view of flexible strip 70. One end portion is provided with a pair of notches 71; the opposing end portion, with a lengthwise slot 72 enlarged at its outermost tip 73.

The notched end portion of strip 70 is adapted to removably pass through slot 72 and reversibly twist into interlocking position at outermost tip 73 for effecting joining of strip 70.

Various materials can be used for the panels of the playhouse. Double-layered corrugated cardboard makes light-weight but satisfactorily strong panels. Single-layered corrugated cardboard can be used for strips 50; plastic, for strips 70.

The size of the playhouse can vary according to the size of the modular units selected. A preferred playhouse is based on a first modular unit (panel 1) with a 30" hypotenuse. The height of panel 1 is approximately seven-eighths as long as its diagonal. Therefore, the table-like structure 30 of the preferred playhouse is 30" square and approximately 26" high.

A larger playhouse might have a table-like structure that is 34" square and approximately 29½" high.

The sections for the modular playhouse (panels 1–6) can also be described in terms of the table-like structure selected. The bottom part of the box used for the table-like structure is square and the height of the elongate members is seven-eighths of the width of said bottom part of said box. The sections comprise a plurality of triangular and rectangular panels. The exterior dimensions of said sections are regulated by the following three units of measure: the width of said bottom part of said box, one-half of the width of the bottom part of said box, and the height of the elongate members. The exterior dimensions of each section comprise at least one of said units of measure. Furthermore, the interior angles of said sections are multiples of thirty degrees.

FIG. 4 shows only one of the many different spatial arrangements which can be built from the panels illustrated in FIG. 1. Additional arrangements could include four-sided cupolas, extended tunnels, A-frames, gable roofs, shed roofs, overhangs, doors that open and close, and doorways like tent flaps.

From the foregoing it can be seen that the modular system of the invention allows great diversity.

Other playhouses have been designed using equal-sided squares and equilateral triangles together with halves of said squares and said equilateral triangles (represented by respective panels 6, 5, 2, and 1). The addition of rectangular panels 3 and 4 to the modular system of the present invention is the key factor which allows the many different configurations for the modular playhouse.

I claim:

1. A modular playhouse comprising a plurality of sections, means for supporting said playhouse, said supporting means having a vertical portion determining its height and generally horizontal portion with sides determining its length and width, and means for connecting said sections ones to the others, the shapes and sizes of said sections regulated by two related modular units, a first of said modular units being essentially a right triangle so proportioned that the hypotenuse thereof is essentially twice as long as the base thereof, a second of said modular units being essentially a rectangle, the length and width of said second modular unit essentially corresponding in measurement to said hypotenuse and said base of said first modular unit respectively, said sections comprising at least one substantially triangular panel having its linear dimensions regulated by the linear dimensions of said first modular unit, and at least one substantially rectangular panel having its linear dimensions regulated by the linear dimensions of said second modular unit, and said supporting means having the linear dimension of its height regulated by the linear dimension of the height of said first modular unit and having the linear dimension of at least one of its sides regulated by the linear dimension of said hypotenuse of said first modular unit.

2. The modular playhouse as claimed in claim 1, wherein said supporting means comprises the lower portion of a box, at least four elongate members, and means for attaching said elongate members to said lower portion of said box to form a table-like structure, the bottom part of said lower portion of said box being essentially square and having its linear dimensions regulated by the linear dimension of said hypotenuse of said first modular unit, and said elongate members each having the linear dimension of its height regulated by the linear dimension of said height of said first modular unit.

3. The modular playhouse as claimed in claim 2 wherein said means for attaching said elongate members comprises at least four joint elements, said joint elements being affixed to the interior corners of said lower portion of said box, each of said joint elements being provided with at least one opening therein, and said elongate members being adapted to be removably inserted into said openings.

4. The modular playhouse as claimed in claim 2 wherein said lower portion of said box is provided with a plurality of apertures near the edges of said bottom part of said box to allow said panels to be connected to said table-like structure.

5. The modular playhouse as claimed in claim 1 wherein said connecting means comprises a plurality of bendable strips and a plurality of continuous elastic bands, said panels being provided with a plurality of apertures therethrough near the peripheral edges thereof, said bendable strips being adapted for removably linking at least two of said panels through said apertures, members of pairs of said apertures being adapted to oppose one another on adjacent panels, said bendable strips being adapted to pass through and extend between said aperture pair members, and said continuous elastic bands being adapted to be removably attached under tension around opposing end portions of respective ones of said bendable strips to hold said opposing end portions contiguous one to another.

6. The modular playhouse as claimed in claim 5 wherein said bendable strips are provided with transverse scorings, the central portions of said bendable strips being marked off by said scorings into at least two segments, said segments being at least as wide as the distance of said panel apertures from the peripheral edges of said panels, and said bendable strips being adapted to bend on said scorings so that said opposing end portions of said bendable strips are contiguous.

7. The modular playhouse as claimed in claim 5, said bendable strips being notched to retain said continuous elastic bands.

8. The modular playhouse as claimed in claim 1 wherein said connecting means comprises a plurality of flexible strips, said panels being provided with a plurality of apertures therethrough near the peripheral edges thereof, said flexible strips being adapted for removably linking at least two of said panels through said apertures, members of pairs of said apertures being adapted to oppose one another on adjacent panels, said flexible strips being adapted to pass through and extend between said aperture pair members, a first end portion of said flexible strips being provided with at least one pair of notches, the end portion of said flexible strips opposing said notched end portion being provided with at least one lengthwise slot therethrough, the outermost tip of said lengthwise slot being enlarged, and said notched end portion being adapted to removably pass through said lengthwise slot and reversibly twist into an interlocking position at said outermost tip for effecting joining of said flexible strips.

9. A modular playhouse comprising a plurality of sections, the shapes and sizes of said sections regulated by two related modular units, a first of said modular units being essentially a right triangle so proportioned that the hypotenuse thereof is essentially twice as long as the base thereof, a second of said modular units being essentially a rectangle, the length and width of said second modular unit essentially corresponding in measurement to said hypotenuse and said base of said first modular unit respectively, means for connecting said sections ones to the others, and means for supporting said modular playhouse, said supporting means comprising the lower portion of a substantially square box adapted for packaging said sections, said box having each side about equal in length to said hypotenuse, at least four elongate members, and means for attaching said elongate members to said lower portion of said box to form a table-like structure.

10. The modular playhouse as claimed in claim 9 wherein said attaching means comprise at least four joint elements, said joint elements being affixed to the interior corners of said lower portion of said box, each of said joint elements being provided with at least one opening therein, and said elongate members being adapted to be removably inserted into said openings to form a table-like structure.

11. The modular playhouse of claim 9 including at least one substantially equilateral-triangular panel having each side substantially equal to said hypotenuse and having at least one rectangular panel having its height equal to the height of said right triangle and its base equal to the base of said right triangle and further having at least one second rectangle having its base substantially equal to said hypotenuse and its height substantially equal to the height of said right triangle and further having at least one third rectangular member having its base substantially equal to the base of said right triangle and its height substantially equal to the hypotenuse of said right triangle.

* * * * *